US008013693B2

(12) United States Patent
Schenkel et al.

(10) Patent No.: US 8,013,693 B2
(45) Date of Patent: Sep. 6, 2011

(54) META-MATERIAL FOR USE IN A BASE STATION OF A WIRELESS COMMUNICATION SYSTEM

(75) Inventors: Horst Schenkel, Eckental (DE); Grzegorz Adamiuk, Karlsruhe (DE); Georg Fischer, Nürnberg (DE)

(73) Assignee: Alcatel Lucent, Paris (FR)

( * ) Notice: Subject to any disclaimer, the term of this patent is extended or adjusted under 35 U.S.C. 154(b) by 141 days.

(21) Appl. No.: 12/224,459

(22) PCT Filed: Mar. 1, 2006

(86) PCT No.: PCT/US2006/007254

§ 371 (c)(1),
(2), (4) Date: Jun. 2, 2009

(87) PCT Pub. No.: WO2007/100324

PCT Pub. Date: Sep. 7, 2007

(65) Prior Publication Data

US 2009/0305074 A1 Dec. 10, 2009

(51) Int. Cl.
*H01P 1/20* (2006.01)
*H01P 3/08* (2006.01)

(52) U.S. Cl. ..... 333/204; 333/202

(58) Field of Classification Search ..... 333/184, 333/185, 190, 192, 202, 204, 205
See application file for complete search history.

(56) References Cited

U.S. PATENT DOCUMENTS 5,534,829 A * 7/1996 Kobayashi et al. ..... 333/126
7,330,090 B2 * 2/2008 Itoh et al. ..... 333/219

* cited by examiner

*Primary Examiner* — Robert Pascal
*Assistant Examiner* — Kimberly E Glenn
(74) *Attorney, Agent, or Firm* — Williams, Morgan & Amerson, PC

(57) ABSTRACT

A meta-material filter that may be used in constructing a duplex filter is provided. The metal-material filter is comprised of a substrate, a plurality of metal strips periodically positioned on the substrate, and a ground plane spaced from the plurality of metal strips. The plurality of metal strips may be arranged mono-periodically or bi-periodically.

21 Claims, 9 Drawing Sheets

META-MATERIAL FOR USE IN A BASE STATION OF A WIRELESS COMMUNICATION SYSTEM

BACKGROUND OF THE INVENTION

1. Field of the Invention

This invention relates generally to telecommunications, and more particularly, to wireless communications.

2. Description of the Related Art

In a telecommunication system, a large geographically distributed network coverage area is typically partitioned into a multiplicity of mobile communication regions, such as cells, where each cell includes a communication node, such as a base station to realize wireless communications with one or more mobile stations or wireless devices within that cell. The network coverage area is commonly based on wireless links that are designed to operate at a minimum level consistent with Quality of Service (QoS) in an area where the mobile station has sufficient power to achieve a target signal-to-noise (SNR) ratio at a cell site that includes the base station.

Continued growth in the number of users of mobile communications means that many wireless network operators or service providers must find new ways of increasing the capacity of their networks. Antenna systems represent an area that may be developed to increase capacity in mobile communication networks. Specifically, many traditional installations of mobile communication base-station antennas make use of space-diversity techniques (e.g., Multiple Input Multiple Output (MIMO) systems), which require at least two antennas pointing in the same direction and separated from each other. A typical base station may now employ as many as six transmitting and six receiving antennas, each requiring its own duplex filter.

The main task of the duplex filter is to separate transmit and receive frequencies at the antenna port. A typical duplex filter thus has three ports, one for the antenna, one for the transmitter and one for the receiver. A typical duplex filter is composed of coaxial resonators that require advanced fabrication techniques and materials to achieve high Q-factors (e.g., ~5000) that are needed to provide high filter selectivity. Filter selectivity is critical in a base station because very sensitive receivers are operated in parallel with strong transmitters. In some applications, MIMO systems have proven to be cost prohibitive because of the cost of the duplex filters alone.

SUMMARY OF THE INVENTION

The present invention is directed to addressing the effects of one or more of the problems set forth above. The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

In one embodiment of the present invention, a meta-material duplex filter is provided. The filter comprises a substrate, a plurality of metal strips periodically positioned on the substrate, and a ground plane. The ground plane is spaced from the plurality of metal strips.

BRIEF DESCRIPTION OF THE DRAWINGS

The invention may be understood by reference to the following description taken in conjunction with the accompanying drawings, in which like reference numerals identify like elements, and in which.

Figure 1:
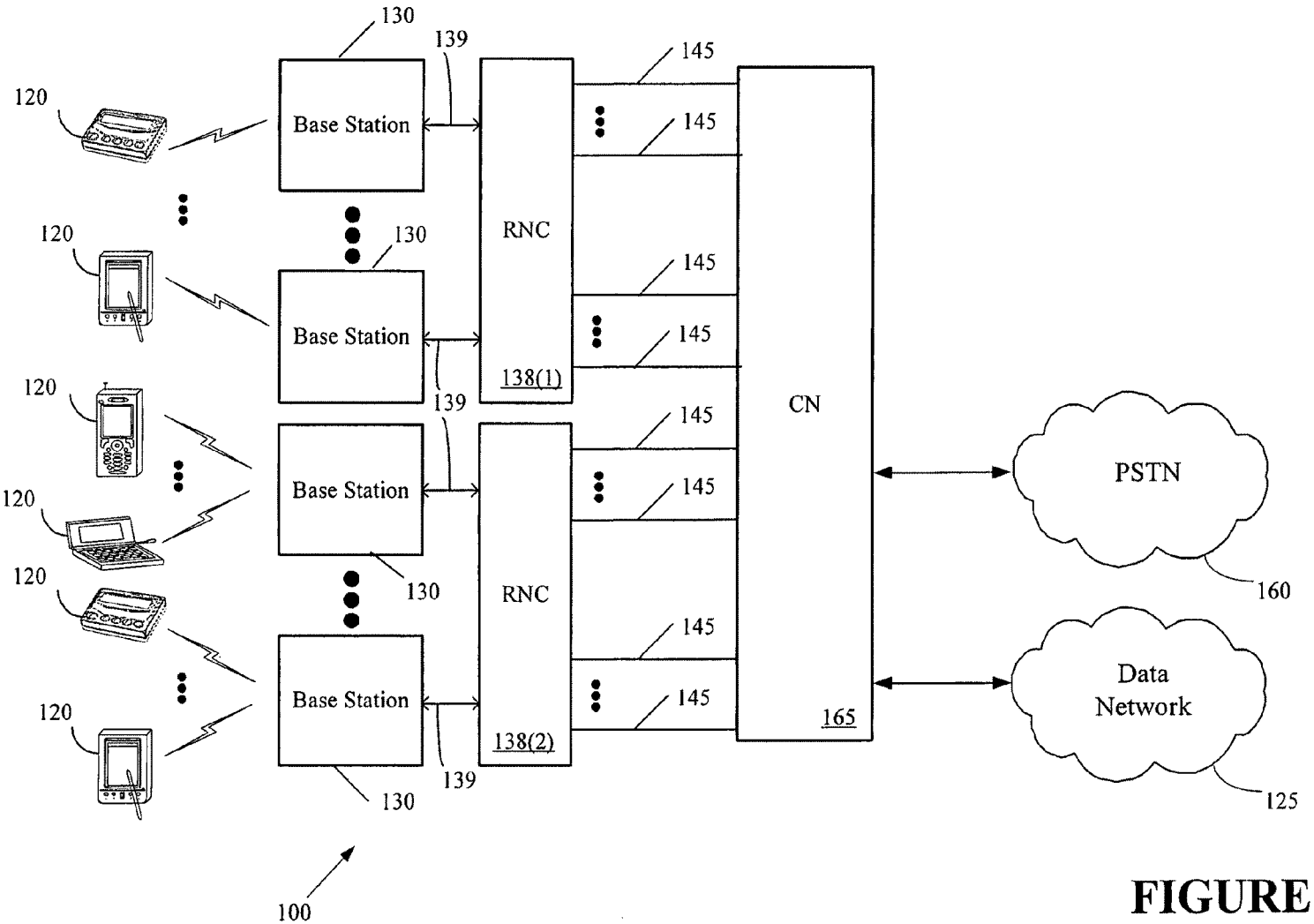
FIG. 1 illustrates a block diagram of a telecommunications system.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation may be described in this specification. It will of course be appreciated that in the development of any such actual embodiment, numerous implementation-specific decisions may be made to achieve the developers' specific goals, such as compliance with system-related and business-related constraints, which may vary from one implementation to another. Moreover, it will be appreciated that such a development effort might be complex and time-consuming, but may nevertheless be a routine undertaking for those of ordinary skill in the art having the benefit of this disclosure.

The present invention will now be described with reference to the attached figures. Various structures, systems and devices are schematically depicted in the drawings for purposes of explanation only and so as to not obscure the present invention with details that are well known to those skilled in the art. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Turning now to the drawings, and specifically referring to FIG. 1, a communications system 100 is illustrated, in accordance with one embodiment of the present invention. For illustrative purposes, the communications system 100 of FIG. 1 is a Universal Mobile Telephone System (UMTS), although it should be understood that the present invention may be applicable to other systems that support data and/or voice Gfi or other forms of communication, such as multimedia. The communications system 100 allows one or more Access Terminals (ATs) 120 to communicate with a data network 125, such as the Internet, and/or a PSTN 160 through one or more base stations 130. The AT 120 may take the form of any of a variety of devices, including cellular phones, personal digital assistants (PDAs), laptop computers, digital pagers, wireless cards, and any other device capable of accessing the data network 125 through the base station 130.

In one embodiment, a plurality of the base stations 130 may be coupled to a Radio Network Controller (RNC) 138(1-2) by one or more connections 139. Although two RNCs 138(1-2) are illustrated, those skilled in the art will appreciate that more RNCs 138 may be utilized to interface with a large number of base stations 130. Generally, the RNC 138 operates to control and coordinate the base stations 130 to which it is connected.

The RNC 138 is also coupled to a Core Network (CN) 165 via a connection 145. Generally the CN 165 operates as an interface to the data network 125 and/or to the PSTN 160. The CN 165 performs a variety of functions and operations, such as user authentication, however, a detailed description of the structure and operation of the CN 165 is not necessary to an understanding and appreciation of the instant invention. Accordingly, to avoid unnecessarily obfuscating the instant invention, further details of the CN 165 are not presented herein.

Thus, those skilled in the art will appreciate that the communications system 100 facilitates communications between the ATs 120 and the data network 125. It should be understood, however, that the configuration of the communications system 100 of FIG. 1 is exemplary in nature, and that fewer or additional components may be employed in other embodiments of the communications system 100 without departing from the spirit and scope of the instant invention.

Figure 2A:
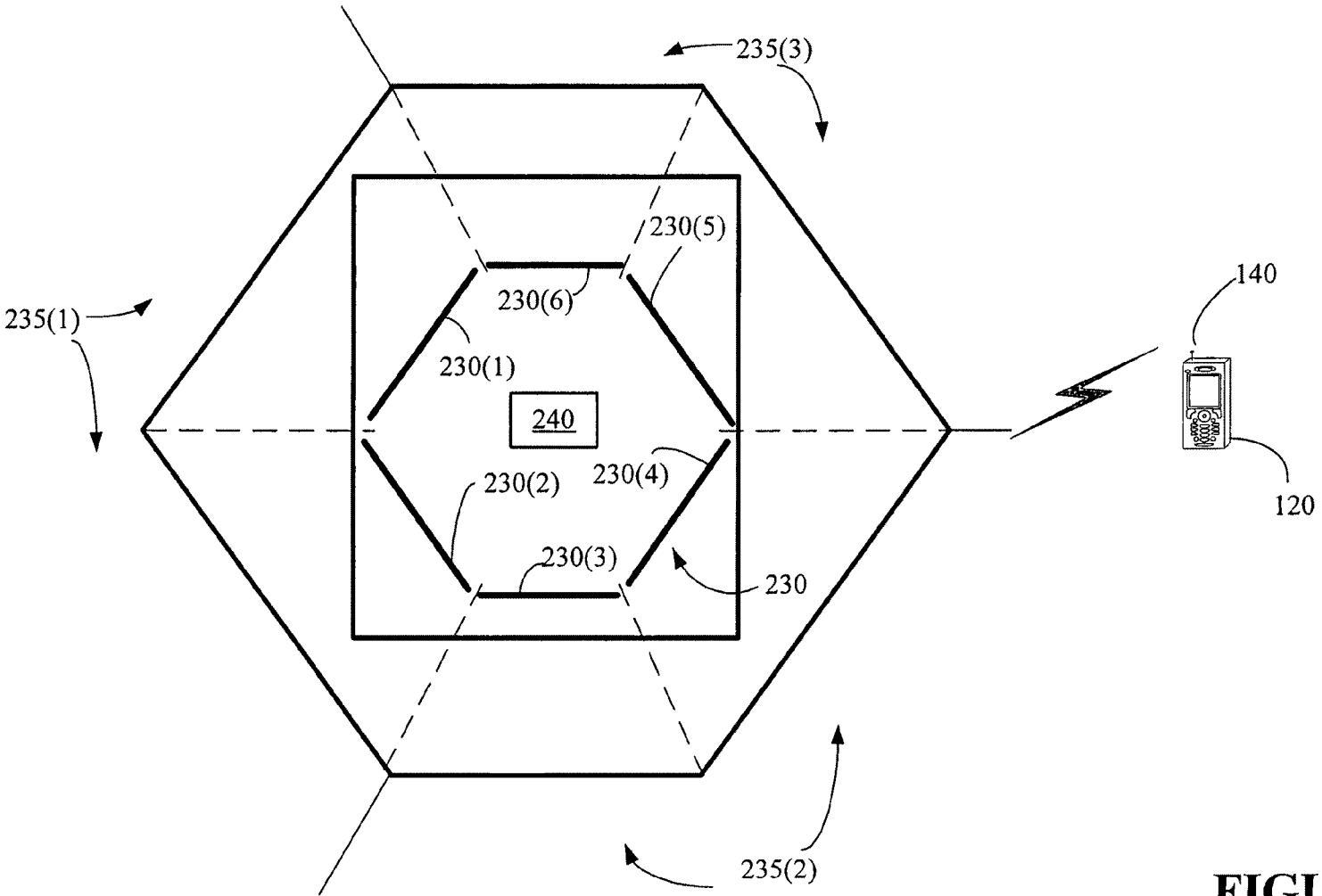
FIG. 2A illustrates a base station of the telecommunications system of FIG. 1 that controls wireless communications with a multi-sector antenna.

Referring now to FIG. 2, the base station 130 may comprise a multi-sector antenna 230 with an antenna arrangement including a plurality of antennas having a first through sixth antenna 230(1-6). The antennas 230(1-6) may be configured to communicate information to and from at least one of a plurality of service coverage areas 235(1-3). The multi-sector antenna 230 may comprise an antenna configuration in which the plurality of antennas 230(1-6) may be arranged in a circular pattern and the AT 120 may not be confined to any particular service coverage area.

Figure 2B:
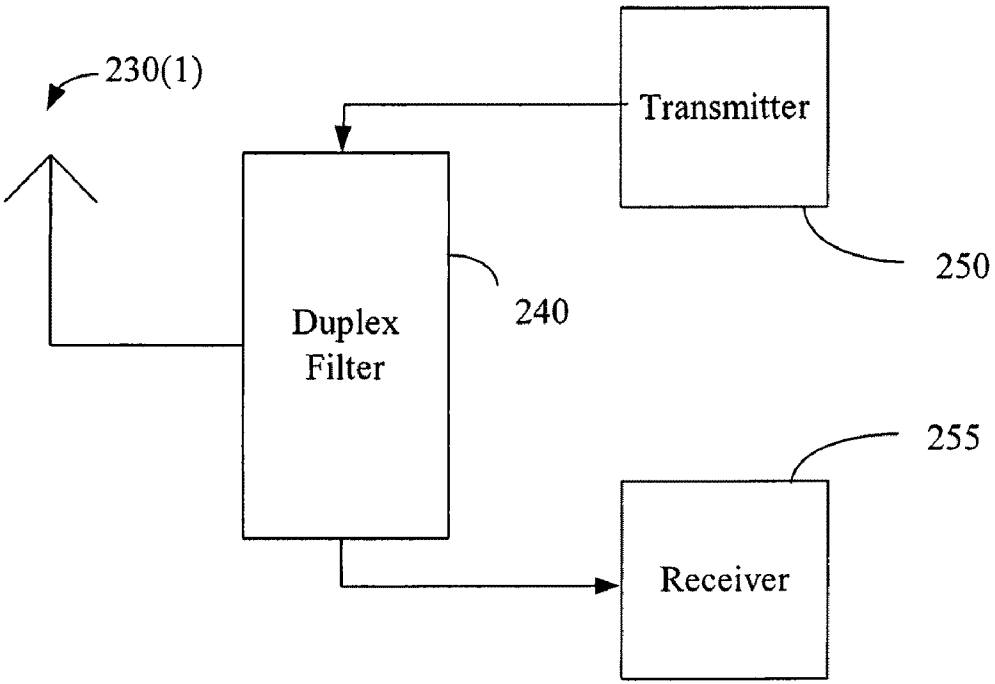
FIG. 2B illustrates a block diagram representation of a relationship between a duplex filter, transmitter, receiver and antenna of the base station of FIG. 2A.

A wireless communication signal received at the antenna 230(1-6) from the AT 120 may be passed through a duplex filter 240. Similarly, a signal transmitted by the base station 130 may be passed through the duplex filter 240 before being sent to the antenna 230(1-6). FIG. 2B illustrates an exemplary embodiment of a relationship between the antenna 230(1), the duplex filter 240, transmitter circuitry 250 and receiver circuitry 255.

Figure 3:
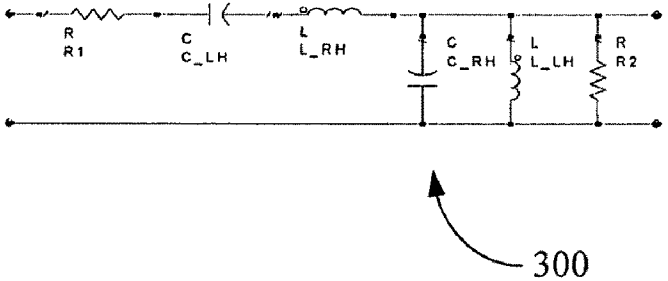
FIG. 3 illustrates an equivalent network unit cell that may be used to construct a duplex filter of FIG. 2.

FIG. 3 illustrates an equivalent network unit cell 300 that may be used to construct the duplex filter 240. In the illustrated embodiment, the equivalent network unit cell 300 for one-dimensional meta-material with capacities and inductivities is shown. To produce a filter effect, the cell 300 is repeated periodically. From the performance of the single unit cell 300 and the required total performance, the number of unit cells 300 may be obtained.

One goal of the duplex filter 240 that is based on meta-material is to have an attenuation of less than 1 dB (similar to a standard CDMA diplexer). To achieve these small losses, a very good matching of the structure is required. Thus, in some applications of the instant invention, it may be useful to optimize the characteristic impedance as well. It should be appreciated that the impedance is a function of the frequency or omega, as Eq. (1) points out.

$$Z_{characteristic} = \sqrt{\frac{L_{RH} + \frac{R_1}{j*\omega} - \frac{1}{\omega^2 * C_{LH}}}{C_{RH} + \frac{1}{R_2 * j * \omega} - \frac{1}{\omega^2 * L_{LH}}}} \qquad \text{Eq. 1}$$

Characteristic Impedance of $CLRH$ structure

Other design considerations of the duplex filter 240 include group delay variation and phase response. To calculate the phase velocity and the resulting value plots, the phase "constant" beta is used. Beta was calculated with equation (2).

$$\beta = N * \mathrm{Im}\left\{\sqrt{\frac{C_{RH}}{C_{LH}} + \frac{L_{RH}}{L_{LH}} + \frac{R_1}{R_2} - \omega^2 * L_{RH} * C_{RH} - \frac{1}{\omega^2 * L_{LH} * C_{LH}} + j*\left(\omega*\left(R_1 * C_{RH} + \frac{L_{RH}}{R_2} - \frac{R_1}{\omega^2 * L_{LH}} - \frac{1}{\omega^2 * R_2 * C_{LH}}\right)\right)}\right\} \qquad \text{Eq. 2}$$

phase constant $\beta$ for $N$ unit cells

Also, the resonance frequencies of the serial (Eq. 3) and parallel part (Eq. 4) are significant parameters of the structure because they define the edges of the bandgap.

$$f_{serial} = \frac{1}{2\pi\sqrt{L_{RH} C_{LH}}} \qquad \text{Eq. 3}$$

Serial resonance frequency of unit cell $$f_{parallel} = \frac{1}{2\pi\sqrt{L_{LH} C_{RH}}} \qquad \text{Eq. 4}$$

Parallel resonance frequency of unit cell

Figure 4A:
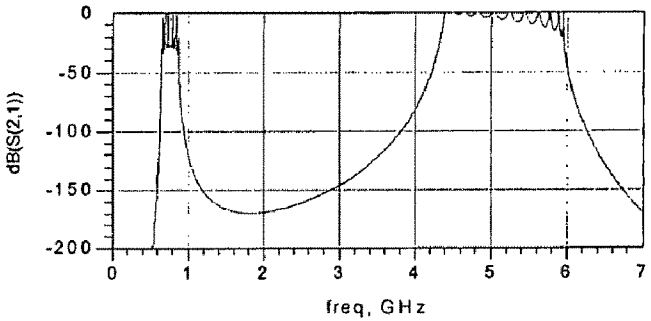
FIGS. 4A and 4B illustrate a transmission and beta (phase constant) graph of a typical un-optimized CLRH structure with 10 unit cells.
Figure 4B:
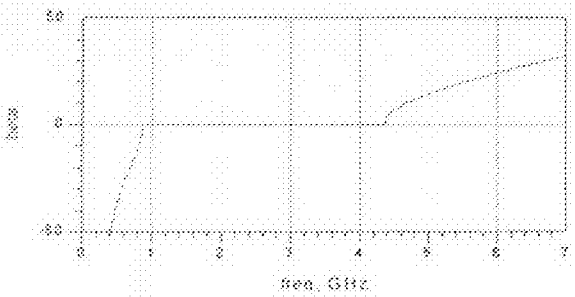

FIGS. 4A and 4B show a transmission and beta graph of a typical un-optimized CLRH structure with 10 unit cells. The peaks in the first graph are results of the resonances (standing waves) in the structure at beta=+/−n*pi/N (N=number of cells, n=resonance index).

Beta is equal to zero at the edges of the bandgap. Near beta=0 at the edges the attenuation is also near zero and therefore highly desirable for filter applications. However, the bandgap itself is not usable because no wave propagation is possible here. Outside and near the bandgap if beta is near 0 almost no resonant current overshoot is flowing through the series resistor and almost no losses appear. At the parallel resistor the voltage can be ignored because this value can be realized very high. So the filter impact at bandgap edge is very high through the steep rising edge at low frequency distance. Additionally a high one-sided Q is feasible and it is not susceptible to the serial losses.

Figure 5A:
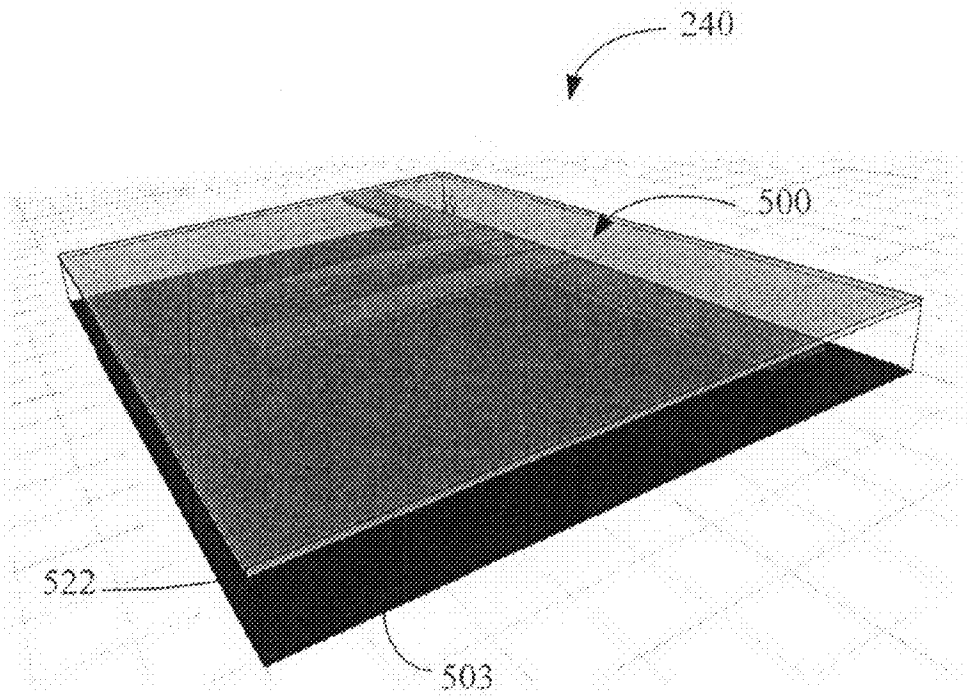
FIGS. 5A, 5B and 5C respectively illustrate a three dimensional view, a cross sectional side view and a cross sectional top view of an exemplary structure of a three cell meta-material filter.
Figure 5C:
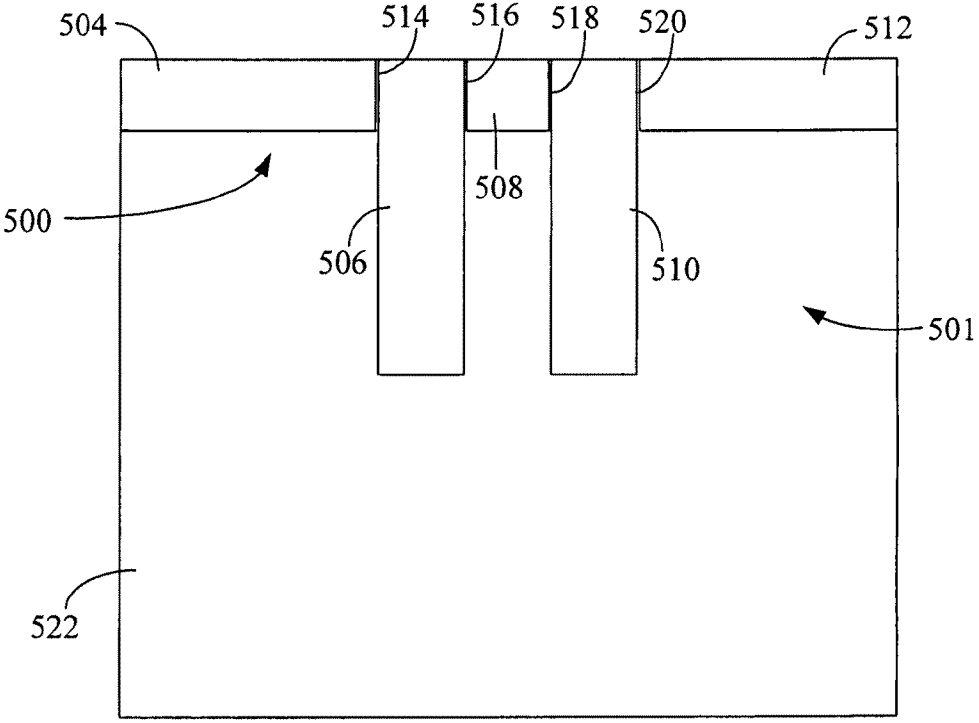
Figure 5B:
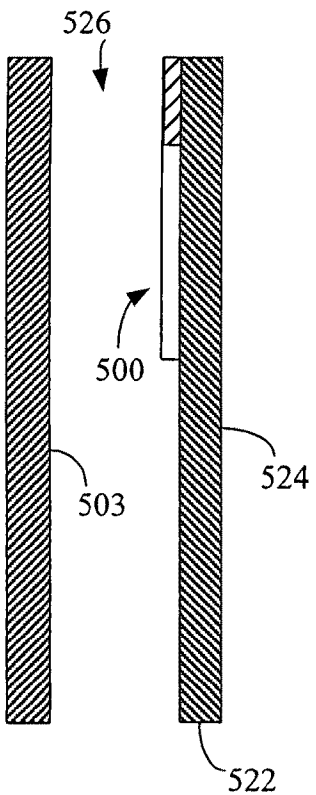

FIGS. 5A, 5B and 5C respectively illustrate a three dimensional view, a cross sectional side view and a cross sectional top view of an exemplary structure of a three cell meta-material filter 501 that may be used to construct half of the duplex filter 240. In the illustrated embodiment, the meta-material duplex filter 501 is comprised of microstrip lines 500 deposited on a substrate 522 and spaced from a ground plane 503. The spacing between the microstrip lines 500 and the ground plane 503 may vary substantially without departing from the spirit and scope of the invention, but in one particular embodiment of the instant invention, the spacing is about 2 mm. The microstrip lines 500 are separated into a first input line 504, first through third wings 506, 508, 510 and a first output line 512 by small coupling slots 514, 516, 518 and 520. The small coupling slots 514, 516, 518 and 520 reduce potential discontinuities inside the RF line and the small slots radiate less, reducing the losses in the filter 501. The small coupling slots 514, 516, 518 and 520 eliminate the need for discrete capacitors, such as SMD or interdigital capacitors, that may otherwise be used. By eliminating SMD capacitors losses to the structure are reduced, and therefore, passband loss and selectivity (e.g., filter steepness) is enhanced. Similarly, by eliminating interdigital capacitors, transverse resonances are reduced, which would otherwise degrade stopband behavior.

Performance of the filter 501 may be altered by varying the slot width and wing length. That is, the filter 501 may be tuned to a particular frequency range and bandwidth by varying the slot width and wing length. For example, in one embodiment of the instant invention, the slots are selected to be about 0.2 mm wide and the wings are about 50 mm long. In one exemplary embodiment of the instant invention, the first input line 504 and the output line 512 are selected to have a width of about 9.7 mm.

The use of microstrip lines 500 allows for the manufacture of the filter 501 using conventional printed circuit board or semiconductor manufacturing techniques. Further, the small coupling slots 514, 516, 518 and 520 may likewise be formed using conventional printed circuit board or semiconductor manufacturing techniques.

The meta-material structure illustrated in FIGS. 5A-5C offers much higher selectivity within the same form factor than a conventional filter. In fact, it has been verified that the Q factor increased from Q=5 to Q=400 within the same form factor using the principles of the instant invention.

In the exemplary embodiment of the instant invention illustrated in FIGS. 5A-5C, the substrate 522 carrying the microstrip lines 500 is not located between the ground plate 503 and the microstrip lines 500, but rather, the substrate 522 is spaced from the microstrip lines 500, which causes the electromagnetic field to be concentrated in the space 526 between the ground plane 503 and the microstrip lines 500 rather than in the substrate 522. Thus, the loss tangent of the substrate 522 does not contribute to a loss mechanism in the filter 501.

It should be appreciated that the upper side 524 of the substrate 522 can be used to carry control lines for tuning elements. The use of electronic tuning elements like varicap diodes or MEMS varactors is attractive with meta-material filters as it can be shown that their losses mainly degrade the passband loss but have less of an affect on filter selectivity, especially for the case of zero order resonances.

Figure 6:
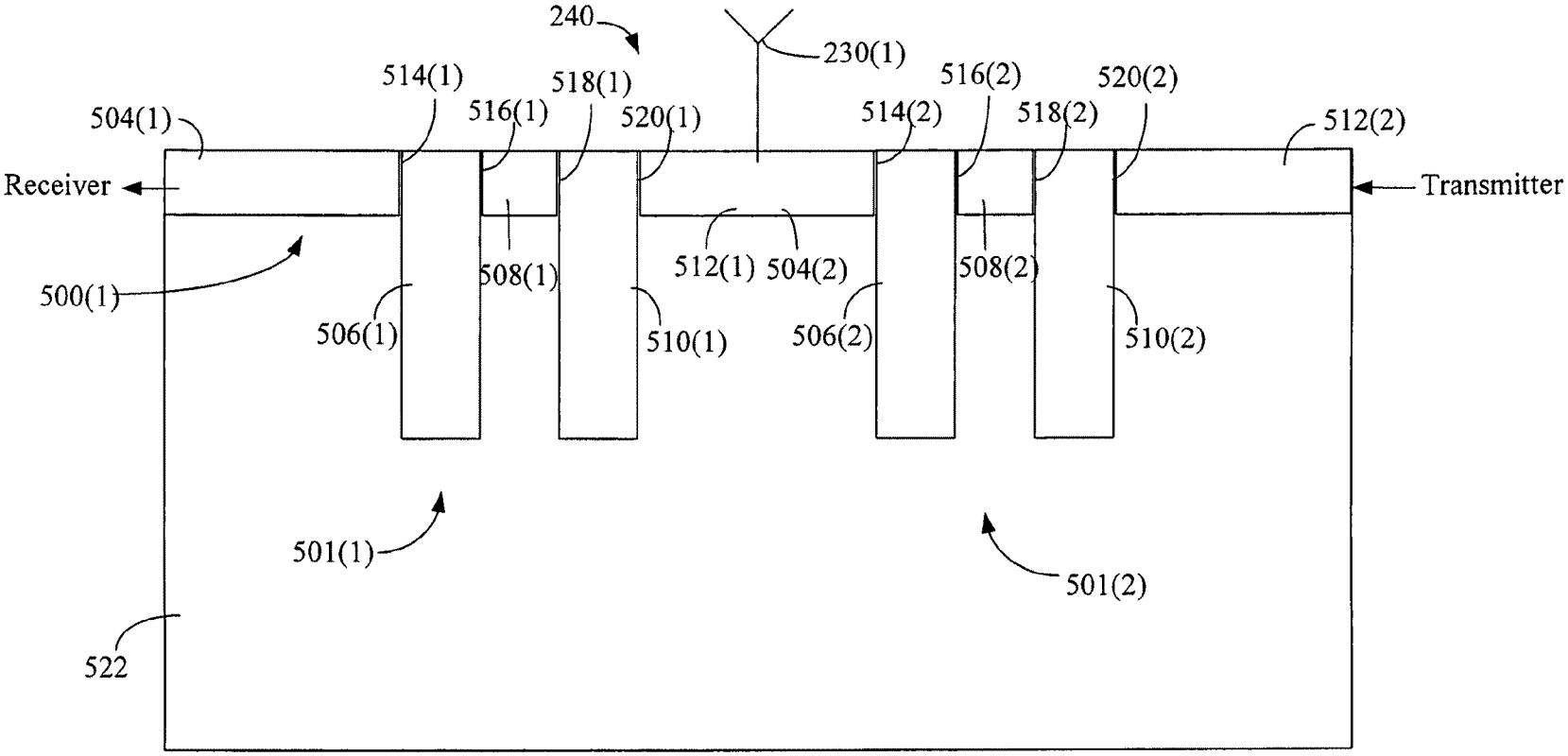
FIG. 6 illustrates one embodiment of a duplex filter conceptually coupled with an antenna.

Turning now to FIG. 6, a pair of the filters 501(1) and 501(2) are arranged to form the duplex filter 240. The input line 504(1) of the first filter 501(1) is coupled to the receiver. The output line 512(2) of the second filter 501(2) is coupled to the transmitter. The output line 512(1) of the first filter 501(1) and the input line 504(2) of the second filter 502(2) are combined and coupled to the antenna 230(1). It should be appreciated that the dimensions of the gaps and wings in the first and second filters 501(1) and 502(1) may be selected to allow signals of different preselected frequencies and bandwidths to pass therethrough. Using meta-material allows the duplex filter 240 to have high port impedances out of their passbands, which is particularly advantageous as it allows filters of different bands to be connected to a common point, such as the antenna port.

Figure 7:
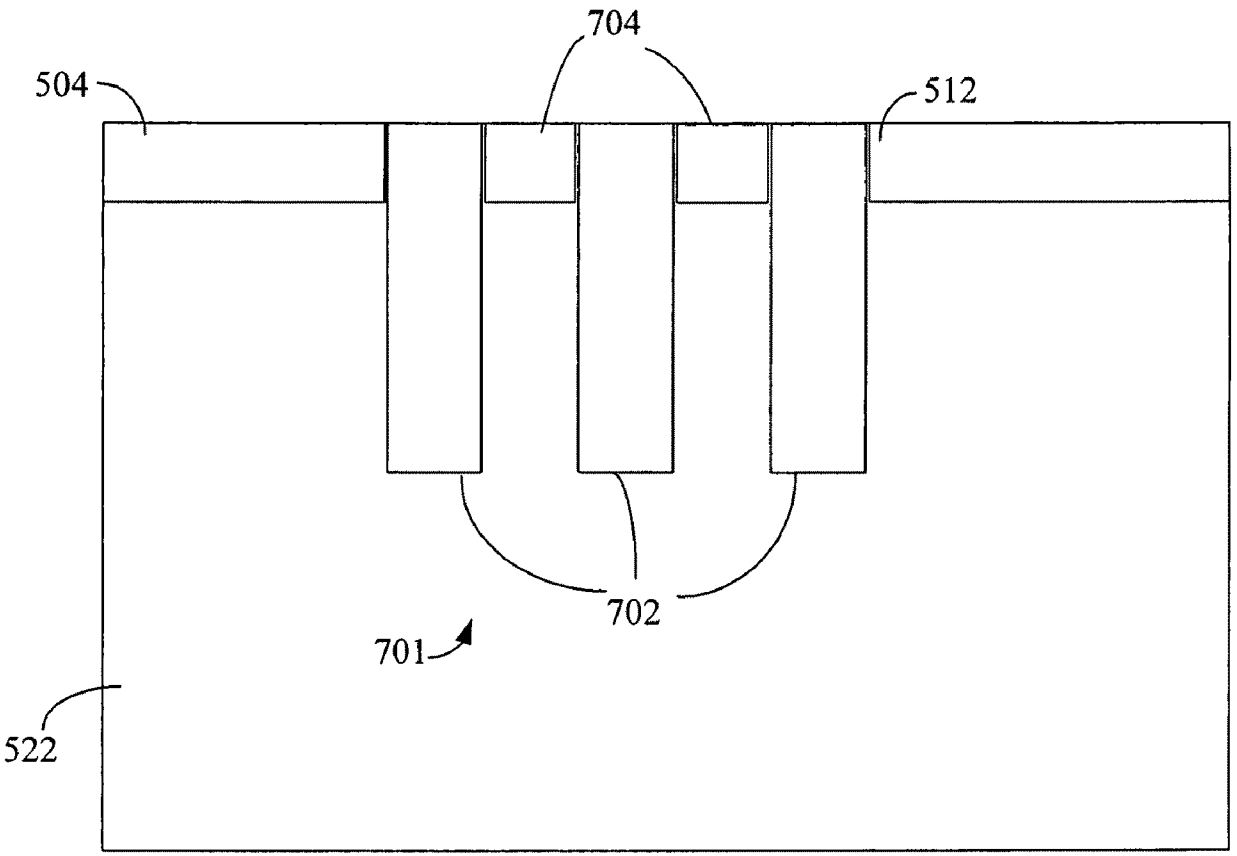
FIG. 7 illustrates a cross sectional top view of an exemplary structure of a bi-periodic seven cell meta-material filter.
Figure 8:
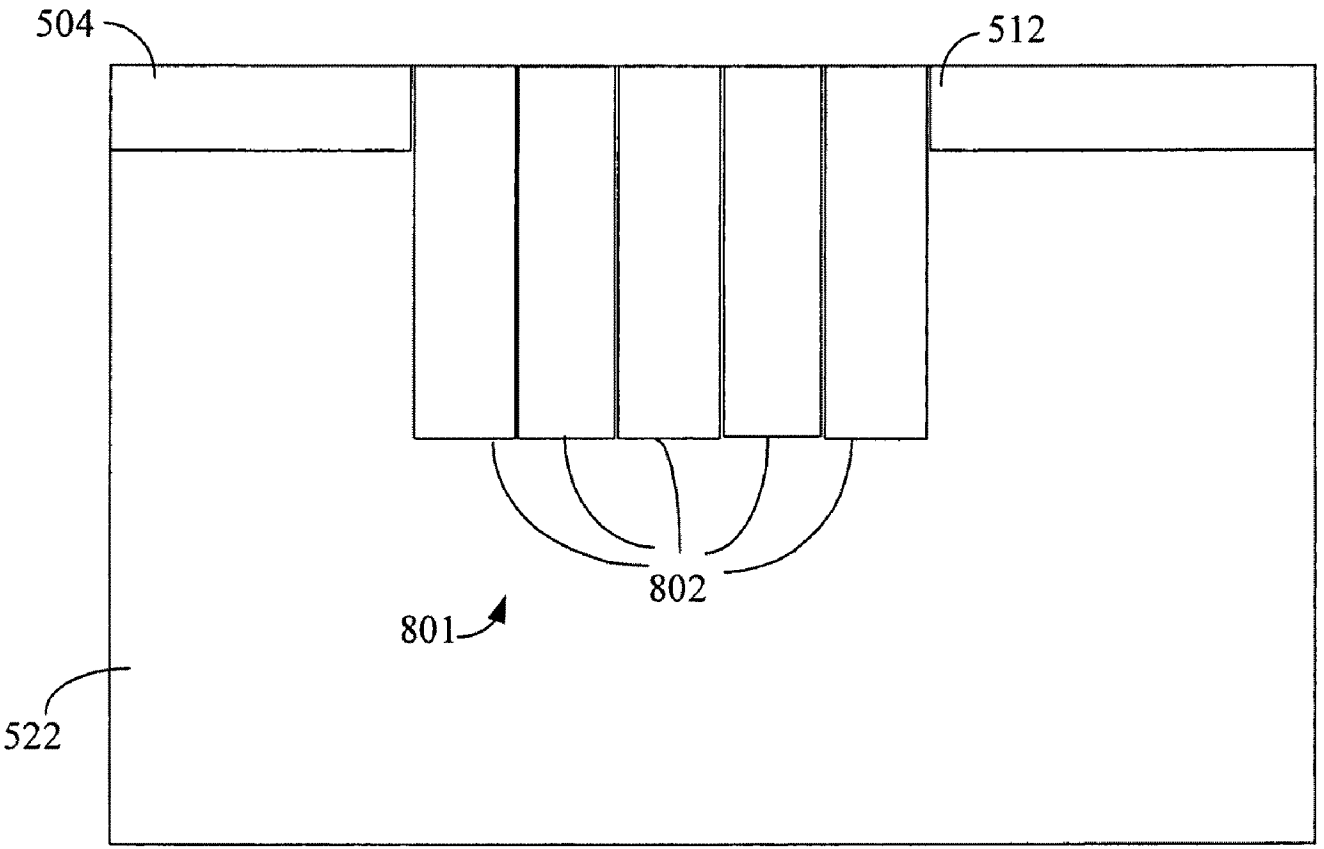
FIG. 8 illustrates a cross sectional top view of an exemplary structure of a mono-periodic seven cell meta-material filter.

FIG. 7 illustrates a cross sectional top view of an exemplary structure of a bi-periodic five cell meta-material filter 701 that may be used to construct the duplex filter 240. Owing to its bi-periodic nature, the filter 701 is constructed from a set of first and second sized wings 702, 704. These first and second sized wings 702, 704 are configured in a bi-periodic arrangement. FIG. 8, on the other hand, illustrates a cross sectional top view of an exemplary structure of a mono-periodic five cell meta-material filter 801 that may be used to construct the duplex filter 240. Owing to its mono-periodic nature, the filter 801 is constructed from a set of five substantially commonly sized wings 802. Both of the filters 701, 801 may be configured to pass preselected frequencies and bandwidths of input signals by selecting the lengths of the wings and the widths of the slots.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A meta-material filter, comprising:

a substrate;

a plurality of metal strips periodically positioned on the substrate, wherein the plurality of metal strips comprise at least first and second size strips arranged in a mono-periodic pattern wherein each of the plurality of metal strips is separated by a slot; and a ground plane spaced from the plurality of metal strips.

2. A meta-material filter, as set forth in claim 1, further comprising the plurality of metal strips being formed from a strip of metal with at least one slot extending therethrough.

3. A meta-material filter, as set forth in claim 2, wherein said at least one slot has a width of about 0.2 mm.

4. A meta-material filter, as set forth in claim 1, wherein each of the plurality of metal strips has a length of about 50 mm.

5. A meta-material filter, as set forth in claim 1, wherein the ground plane is spaced from the plurality of metal strips by a distance of about 2 mm.

6. A meta-material filter, as set forth in claim 1, wherein the plurality of metal strips comprises at least first and second size strips arranged in a periodic pattern wherein each of the plurality of metal strips is separated by a slot.

7. A meta-material filter, as set forth in claim 1, wherein the plurality of metal strips comprises at least first and second size strips arranged in a bi-periodic pattern wherein each of the plurality of metal strips is separated by a slot.

8. A meta-material filter, as set forth in claim 1, further comprising an input line formed on the substrate and coupled to at least one of the plurality of metal strips, and an output line formed on the substrate and coupled to at least one of the plurality of metal strips.

9. A meta-material filter, as set forth in claim 1, further comprising a second meta-material filter coupled to the first meta-material filter to form a duplex filter.

10. A meta-material filter, as set forth in claim 9, wherein the second meta-material filter comprises:

a plurality of metal strips periodically positioned on the substrate and spaced from the ground plane.

11. A meta-material filter for filtering radiofrequency (RF) signals in a band centered on a center frequency that is associated with a characteristic wavelength, comprising: a substrate; a plurality of metal strips periodically positioned on the substrate, each of the plurality metal strip has a characteristic dimension that is less than or equal to 1/10 of the characteristic wavelength; and a ground plane spaced from the plurality of metal strips.

12. A meta-material filter, as set forth in claim 11, further comprising the plurality of metal strips being formed from a strip of metal with at least one slot extending there through so that the meta-material filter has at least one resonant frequency near the center frequency.

13. A meta-material filter, as set forth in claim 12, wherein said at least one slot has a width of about 0.2 mm.

14. A meta-material filter, as set forth in claim 11, wherein the center frequency is less than or equal to 0.6 GHz, and wherein each of the plurality of metal strips has a length of about 50 mm.

15. A meta-material filter, as set forth in claim 11, wherein the ground plane is spaced from the plurality of metal strips by a distance of about 2 mm.

16. A meta-material filter, as set forth in claim 11, wherein the plurality of metal strips comprises at least first and second size strips arranged in a periodic pattern wherein each of the plurality of metal strips is separated by a slot.

17. A meta-material filter, as set forth in claim 11, wherein the plurality of metal strips comprises at least first and second size strips arranged in a mono-periodic pattern wherein each of the plurality of metal strips is separated by a slot.

18. A meta-material filter, as set forth in claim 11, wherein the plurality of metal strips comprises at least first and second size strips arranged in a bi-periodic pattern wherein each of the plurality of metal strips is separated by a slot.

19. A meta-material filter, as set forth in claim 11, further comprising an input line formed on the substrate and coupled to at least one of the plurality of metal strips, and an output line formed on the substrate and coupled to at least one of the plurality of metal strips.

20. A meta-material filter, as set forth in claim 11, wherein the plurality of metal strips are configured to receive a wireless communication signal from an antenna and provide a filtered wireless communication signal.

21. A meta-material filter, as set forth in claim 11, further comprising a second meta-material filter formed on the substrate and coupled to the first meta-material filter to form a duplex filter, wherein the second meta-material filter comprises a plurality of metal strips periodically positioned on the substrate and spaced from the ground plane, and wherein each of the plurality of metal strips has a characteristic dimension that is less than or equal to 1/10 of the characteristic wavelength.

* * * * *